US012320221B2

(12) United States Patent
McKeon et al.

(10) Patent No.: US 12,320,221 B2
(45) Date of Patent: Jun. 3, 2025

(54) WELLHEAD ASSEMBLY MONITORING SENSOR AND METHOD

(71) Applicant: Cameron International Corporation, Houston, TX (US)

(72) Inventors: Michael Anthony McKeon, Longford (IE); Edmund Peter McHugh, Longford (IE); Declan Elliott, Longford (IE); Finbarr Evans, Longford (IE); Michael Mullin, Longford (IE)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 18/560,184

(22) PCT Filed: May 20, 2022

(86) PCT No.: PCT/US2022/030311

§ 371 (c)(1),
(2) Date: Nov. 10, 2023

(87) PCT Pub. No.: WO2022/246236

PCT Pub. Date: Nov. 24, 2022

(65) Prior Publication Data

US 2024/0229588 A1 Jul. 11, 2024

Related U.S. Application Data

(60) Provisional application No. 63/191,346, filed on May 21, 2021.

(51) Int. Cl.
*E21B 33/03* (2006.01)

(52) U.S. Cl.
CPC ..... *E21B 33/03* (2013.01)

(58) Field of Classification Search
CPC ..... E21B 33/00; E21B 33/02; E21B 33/03; E21B 33/068
See application file for complete search history.

(56) References Cited

U.S. PATENT DOCUMENTS 2,859,010 A 11/1958 Ferrell
3,072,142 A 1/1963 Yancey
(Continued)

FOREIGN PATENT DOCUMENTS

CA 2461402 A1 9/2005
EP 2769050 A1 8/2014
(Continued)

OTHER PUBLICATIONS

International Search Report and Written Opinion issued in the PCT Application PCT/US2022/030311, dated Sep. 2, 2022 (11 pages).

*Primary Examiner* — Kristyn A Hall
(74) *Attorney, Agent, or Firm* — Jeffrey D. Frantz

(57) ABSTRACT

An apparatus includes a sensor for sensing pressure, temperature, or another physical parameter at a wellhead assembly or other oilfield component. In one embodiment, an apparatus includes a wellhead body and a branch assembly coupled to the wellhead body such that a bore of the branch assembly is in fluid communication with an interior of the wellhead body through an access passage of the wellhead body. The branch assembly includes a penetration extending outwardly from the bore to an exterior surface of the branch assembly that is radially outward of the bore, and a sensor is installed in the penetration of the branch assembly. Additional systems, devices, and methods are also disclosed.

18 Claims, 11 Drawing Sheets

(56) References Cited

U.S. PATENT DOCUMENTS

| | | | |
|---|---|---|---|
| 3,466,001 | A | 9/1969 | Nelson |
| 4,503,879 | A | 3/1985 | Lazarus |
| 4,662,603 | A | 5/1987 | Etheridge |
| 5,299,640 | A | 4/1994 | Streich et al. |
| 5,497,672 | A | 3/1996 | Appleford et al. |
| 5,918,627 | A | 7/1999 | Oshiro |
| 6,050,338 | A | 4/2000 | Watkins |
| 6,086,039 | A | 7/2000 | Sievers et al. |
| 6,186,239 | B1 | 2/2001 | Monjure et al. |
| 6,695,049 | B2 | 2/2004 | Ostocke et al. |
| 6,957,703 | B2 | 10/2005 | Trott et al. |
| 7,566,045 | B2 | 7/2009 | June |
| 8,181,705 | B2 | 5/2012 | Tveiten et al. |
| 8,186,440 | B2 | 5/2012 | Tveiten et al. |
| 8,261,771 | B2 | 9/2012 | Witkowski et al. |
| 8,640,776 | B2 | 2/2014 | Tveiten et al. |
| 8,684,073 | B2 | 4/2014 | Sevheim et al. |
| 9,371,713 | B2 | 6/2016 | Kleppa |
| 9,422,789 | B2 | 8/2016 | Bushman et al. |
| 9,500,062 | B2 | 11/2016 | Tveiten et al. |
| 9,611,720 | B2 | 4/2017 | Sevheim |
| 10,450,821 | B2 | 10/2019 | Guedes |
| 10,876,370 | B2 | 12/2020 | Tibbs et al. |
| 11,261,978 | B2 | 3/2022 | Pivowar et al. |
| 11,680,483 | B2 | 6/2023 | Gray et al. |
| 11,976,534 | B2 | 5/2024 | Guidry et al. |
| 2002/0020558 | A1 | 2/2002 | Gonzalez et al. |
| 2002/0153143 | A1 | 10/2002 | Compton et al. |
| 2003/0019631 | A1 | 1/2003 | DeBerry |
| 2003/0150620 | A1 | 8/2003 | DeBerry et al. |
| 2006/0060348 | A1 | 3/2006 | Allen et al. |
| 2006/0254822 | A1 | 11/2006 | Ayling |
| 2007/0169940 | A1 | 7/2007 | Fenton et al. |
| 2009/0000781 | A1 | 1/2009 | Bolding |
| 2009/0020382 | A1 | 1/2009 | Van Weelden et al. |
| 2010/0044054 | A1 | 2/2010 | de Boer |
| 2011/0011599 | A1 | 1/2011 | Nguyen et al. |
| 2012/0152564 | A1 | 6/2012 | Peltier |
| 2012/0222760 | A1 | 9/2012 | Marica |
| 2014/0000907 | A1 | 1/2014 | Olvera et al. |
| 2014/0216715 | A1 | 8/2014 | Kleppa |
| 2014/0216757 | A1 | 8/2014 | Kleppa |
| 2014/0246197 | A1 | 9/2014 | Smith et al. |
| 2015/0059472 | A1 | 3/2015 | McHugh |
| 2015/0345253 | A1 | 12/2015 | Braekke |
| 2016/0010417 | A1 | 1/2016 | Lockwood |
| 2017/0037980 | A1 | 2/2017 | Arian et al. |
| 2017/0175488 | A1 | 6/2017 | Lisowski et al. |
| 2017/0284277 | A1 | 10/2017 | Wardle et al. |
| 2018/0010420 | A1 | 1/2018 | Shirley et al. |
| 2018/0179854 | A1 | 6/2018 | Healy |
| 2019/0277137 | A1 | 9/2019 | Gray |

FOREIGN PATENT DOCUMENTS

| | | | |
|---|---|---|---|
| GB | 2132728 | A | 7/1984 |
| GB | 2346630 | A | 8/2000 |
| NO | 333416 | B1 | 6/2013 |
| WO | 2003016673 | A1 | 2/2003 |
| WO | 2016046533 | A1 | 3/2016 |
| WO | 2017023812 | A1 | 2/2017 |
| WO | 2018106119 | A2 | 6/2018 |
| WO | 2018160070 | A1 | 9/2018 |
| WO | 2021231833 | A1 | 11/2021 |

WELLHEAD ASSEMBLY MONITORING SENSOR AND METHOD

CROSS-REFERENCE TO RELATED APPLICATIONS

The present application is a National Stage Entry of International Application No. PCT/US2022/030311, filed May 20, 2022, which claims priority benefit of U.S. Provisional Application No. 63/191,346, filed May 21, 2021, the entirety of which is incorporated by reference herein and should be considered part of this specification.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is accessed and extracted. These wellhead assemblies may include a wide variety of components, such as various casings, wellhead components, trees, valves, fluid conduits, and the like.

In order to maximize the rate of drilling and avoid formation fluids entering the well, it is desirable to maintain the bottom hole pressure (BHP) in the annulus at a level above, but relatively close to, the pore pressure. Maintaining the BHP above the pore pressure is referred to as overbalanced drilling. As BHP increases, drilling rate will decrease, and if the BHP is allowed to increase to the point it exceeds the fracture pressure, a formation fracture can occur. Pressures in excess of the formation fracture pressure will result in the fluid pressurizing the formation walls to the extent that small cracks or fractures will open in the borehole wall and the fluid pressure overcomes the formation pressure with significant fluid invasion. Fluid invasion can result in reduced permeability, adversely affecting formation production. Once the formation fractures, returns flowing in the annulus may exit the open wellbore thereby decreasing the fluid column in the well. If this fluid is not replaced, the wellbore pressure can drop and allow formation fluids to enter the wellbore, causing a kick and potentially a blowout. Therefore, the formation fracture pressure defines an upper limit for allowable wellbore pressure in an open wellbore. The pressure margin between the pore pressure and the fracture pressure is known as a window. Measuring annular pressure ensures operators are aware of pressure changes in the annulus and can respond accordingly to ensure the mechanical design limits are not exceeded and operations remain within the window.

Various wellhead assembly components and other oilfield components can include ports for accessing internal volumes. A wellhead can include access ports in fluid communication with various annuluses in the well, for example. External valves, such as gate valves, can be attached to the side of the wellhead to control flow through the access ports, which may also be referred to as outlet ports. In some instances, a plug may be installed through an external valve and threaded into an outlet port to seal the outlet port and allow the external valve to be removed from the wellhead. Pressure in the annulus may also be measured via the outlet port. Some known technologies for measuring annular pressure require the operator to leave two wellhead annular valves in series open to allow fluid from the annulus to flow from the annulus through the wellhead annular valves to take a reading at a measurement location beyond the annular valves (e.g., at a capped end of the valves distal from the outlet port) or to send someone to take a periodic measurement, creating risks for the operator safety and environment. This method in not preferred as with both annular valves open, the pressure barriers to atmosphere are reduced to one. In some other instances, a pressure sensor installed in an outlet port plug may be used to measure annulus pressure, but removal of such a pressure sensor from the outlet port may require a variety of equipment rig up, such as additional valves and lubricator tooling. It would thus be beneficial to provide environmentally safe annular measurements as proposed with the sensor system described in the present disclosure.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

Certain embodiments of the present disclosure generally relate to an annulus monitoring sensor and method and, more particularly, to a sensor to measure annular pressure and temperature on wells for continuous monitoring. In some embodiments, a sensor is installed in a penetration of a flange or of a valve body for measuring one or more parameters, such as temperature, pressure, density, or humidity. The flange or valve body may be installed in a branch assembly coupled to receive fluid from a wellhead annulus through a wellhead access port in some instances, such that the sensor may be used to measure annular pressure or temperature via the fluid received from the annulus. The sensor may be installed in the penetration to form a metal-to-metal seal between a sealing surface of the sensor and an abutting surface of the flange or valve body. A plug installed in the penetration may provide an additional metal-to-metal seal, thus achieving dual metal sealing to atmosphere, and include conductors to facilitate communication between the sensor and an external device.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
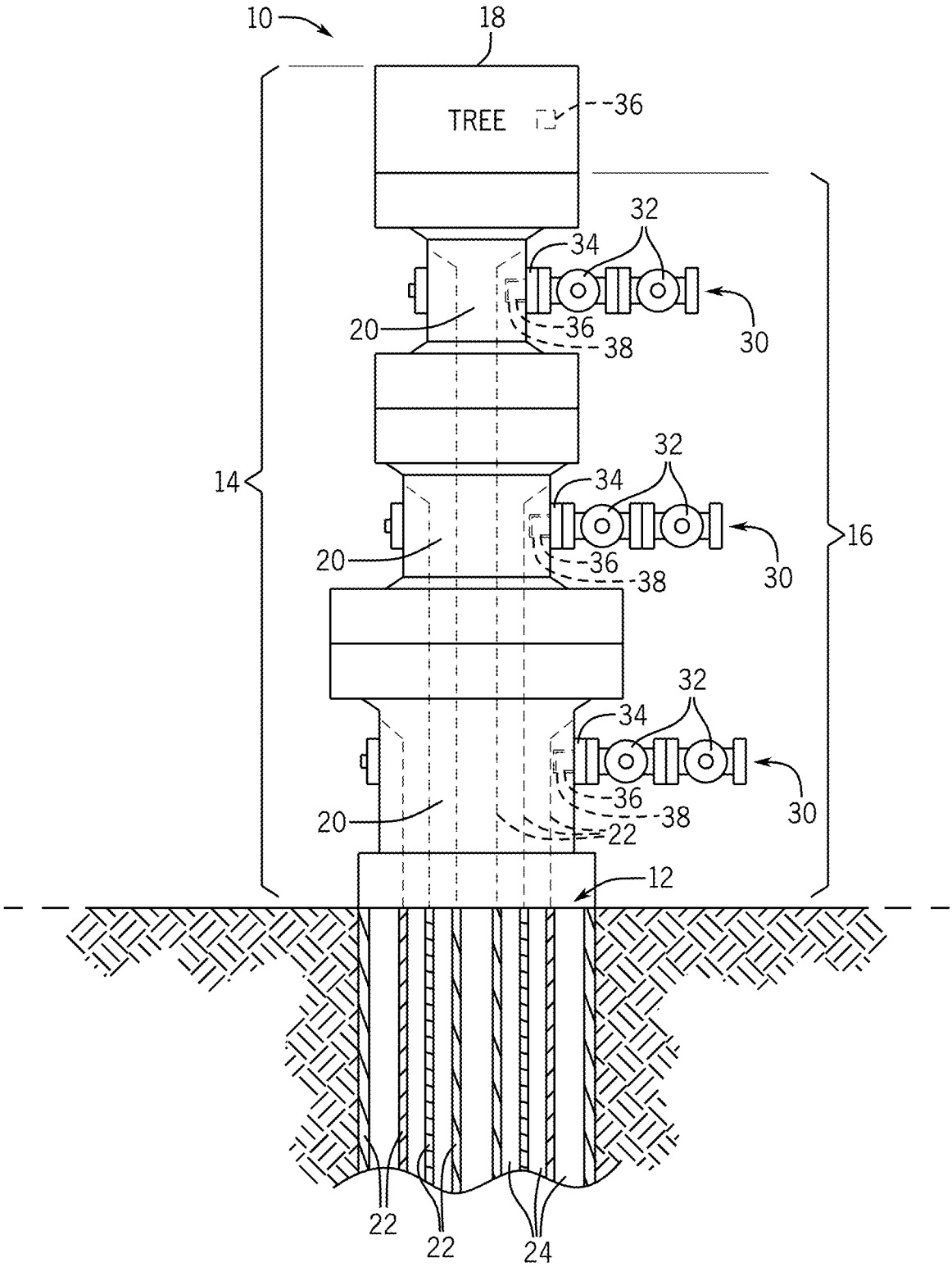
FIG. 1 depicts a well apparatus including a wellhead with branch assemblies having valves and instrument flanges in which sensors may be installed in accordance with an embodiment of the present disclosure.

Turning now to the present figures, an apparatus 10 is illustrated in FIG. 1 by way of example. The apparatus 10 is a well installation that facilitates production of a resource, such as oil or gas, from a reservoir through a well 12. A wellhead assembly 14 of the apparatus 10 in FIG. 1 includes a wellhead 16 and a tree 18. The wellhead 16 is depicted as having heads 20 (e.g., casing and tubing heads), but the components of the wellhead 16 can differ between applications and could include a variety of casing heads, tubing heads, spools, hangers, sealing assemblies, valves, and pressure gauges, to name only a few possibilities. The tree 18 may be a production tree, a fracturing tree, or some other tree coupled to the wellhead 16.

Various tubular strings 22, such as casing and tubing strings, extend into the ground below the wellhead assembly 14. As will be appreciated, casing strings generally serve to stabilize wells and to isolate fluids within wellbores from certain formations penetrated by the wells (e.g., to prevent contamination of freshwater reservoirs), and tubing strings facilitate flow of fluids through the wells. Hangers can be attached to casing and tubing strings and received within wellheads to enable these tubular strings to be suspended in the wells from the hangers. The wellhead assembly 14 can be mounted on the outermost tubular string 22 (e.g., a conductor pipe) and each of the remaining tubular strings 22 may extend downwardly into the ground from a casing or tubing head 20. In one embodiment, the innermost tubular string 22 is a tubing string and the remaining tubular strings 22 are casing strings.

The tubular strings 22 define annular spaces 24, which may also be referred to as annuluses or annuli 24. Branch assemblies 30 are shown connected to the heads 20 in FIG. 1. In some embodiments, these branch assemblies 30 include valves that may be used to selectively permit flow between the wellhead assembly 14 and external equipment. In FIG. 1, for instance, the branch assemblies 30 include valves 32 mounted outside the casing and tubing heads 20 and in-line with annulus access passages 38 in the heads 20 to control flow between the annuluses 24 and external equipment through the access passages. The gate valves 32 could be mounted directly to the heads 20, but in some embodiments one or more other components are interposed between the gate valves 32 and the heads 20. As shown in FIG. 1, for example, separate flanges 34 (e.g., instrument flanges) are installed between the gate valves 32 and the heads 20.

As discussed in greater detail below, one or more of the valves 32 or flanges 34 of a branch assembly 30 may include a sensor for measuring a characteristic of fluid received within the valve 32 or flange 34 from an annulus 24 through an access passage 38 of the wellhead. That is, by allowing fluid to flow from an annulus 24, through the access passage 38, and into the valve 32 or flange 34, the sensor installed in the valve 32 or flange 34 may be used to measure annulus fluid characteristics, such as temperature, pressure, density, humidity, or the like. In at least some instances, the sensor is installed in a branch assembly 30 inboard of the closing elements (e.g., gates) of the valves 32. That is, the sensor can be positioned at a location that is between the head 20 and the closing elements (e.g., gates) of the valves 32 of the branch assembly 30, such as in the flange 34 or an inboard portion of a valve 32 closest to the head 20. In such a position, the sensor can sense one or more characteristics (e.g., annulus pressure and temperature) with both valves 32 of the branch assembly 30 in a fully closed position (e.g., with gates of valves 32 blocking flow through the branch assembly 30). Thus, in at least some instances, annulus pressure, temperature, or other parameters can be measured via the sensor while valves 32 remain closed to provide dual barriers to flow through the branch assembly.

In addition to or instead of the valves 32 mounted outside the casing and tubing heads 20, valves 36 (e.g., annulus safety valves) may be installed or integrated into pressure-containing components of the wellhead 16 (e.g., in heads 20), the tree 18, or other equipment to control flow through access passages. In some embodiments, for instance, valves 36 may be integrated into hollow bodies of such pressure-containing components to control flow through access passages in fluid communication with bores in the components. More specifically, the valves 36 may be used as annulus safety valves installed in ports of the wellhead 16 to control access to the annuluses 24 in some cases, but the valves 36 may be used in different applications in other cases. These internal valves 36 can include sealing elements that can be moved between an open position to allow flow through an access passage 38 and a closed position to block flow through the access passage 38. Consequently, the valves 36 can be opened to enable fluid flow into or out of the components. In certain embodiments, the valves 36 are positioned fully within a hollow body of a pressure-containing component (e.g., along an access passage) and do not protrude outwardly from the pressure-containing component.

Further, in at least some instances an internal valve 36 in an access passage 38 of a pressure-containing body (e.g., an annulus outlet port of a wellhead) can be used, in lieu of a separate valve-removal (VR) plug in the access passage 38, to block flow through the access passage 38 and facilitate removal of an external valve 32 or flange 34 attached in fluid communication with the access passage 38. Such an internal valve 36, which may be referred to as a valve-removal (VR) valve, can remain in the access passage 38 to control flow even after removal of the external valve 32 or flange 34. In other embodiments, however, a VR plug may be installed in the access passage 38 to facilitate removal of the external valve 32 or flange 34.

Increases in annular pressure can arise due to internal leaks or when the fluids in the annulus are heated by production and expand. Measuring annular pressure ensures operators are aware of pressure changes in the annulus and can respond accordingly to ensure the mechanical design limits are not exceeded. At least some embodiments of the sensor system of the disclosure enable continuous monitoring of annular pressure and/or temperature on wells without plugging an annulus access port. The present techniques may also or instead be used for measuring other characteristics of a fluid, such as density, humidity, or other physical parameters. And while such measurements may be taken for determining characteristics of fluid in a well annulus, the present techniques may be used in other applications (i.e., to measure characteristics other than those related to an annulus). In at least some embodiments, the system described below provides dual barriers (e.g., primary and secondary well barriers) to the external environment, while providing continuous pressure and temperature measurements, to ensure well integrity is maintained.

Figure 2:
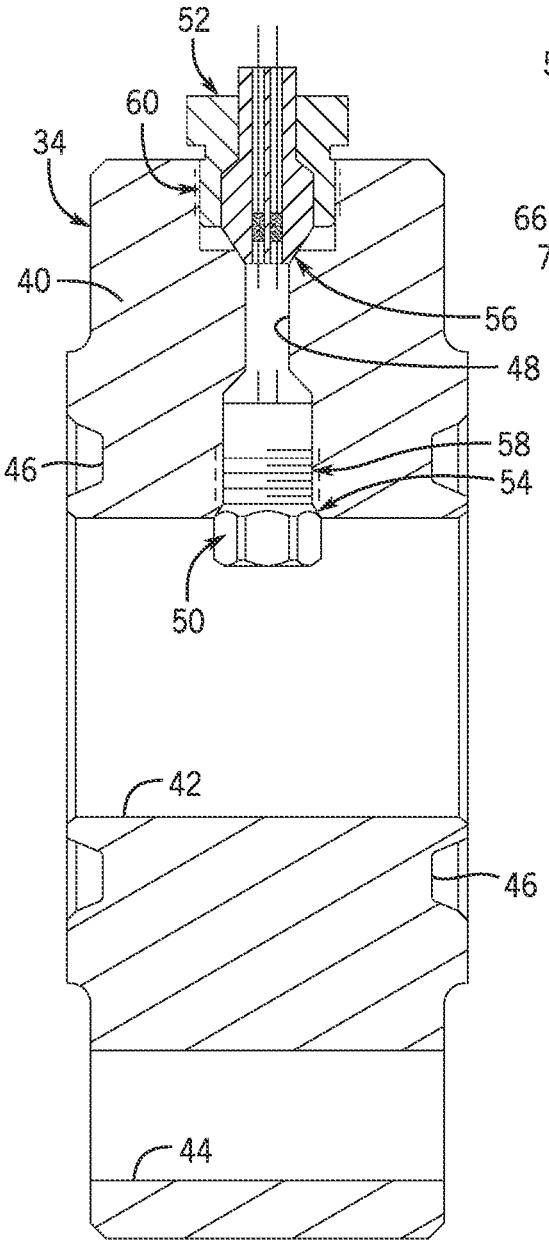
FIG. 2 depicts a sensor and a plug installed in a penetration in an instrument flange in accordance with one embodiment.

One example of an instrument flange 34 instrumented with a sensor is depicted in FIG. 2. In this depicted embodiment, the flange 34 includes a body 40 having a main through-bore 42, mounting holes 44 (which facilitate a studded or bolted connection to other components), and seal grooves 46 for receiving gaskets (e.g., BX ring gaskets). A penetration 48 extends outwardly from the bore 42 to an exterior surface of the flange 34 that is radially outward of the bore 42. In FIG. 2, the penetration 48 is formed perpendicular to, and extends radially outward from, the bore 42. In other instances, however, the penetration 48 may be provided at some other angle (i.e., not perpendicular) with respect to the bore 42.

The sensor system of FIG. 2 includes a sensor 50 installed in the penetration 48. The sensor 50 may include one or more of a pressure gauge, a temperature gauge, a humidity gauge, a density gauge, or a gauge for measuring some other physical parameter. In operation, the sensor 50 may be exposed to fluid from the annulus (e.g., fluid received in the bore 42 from an annulus 24) to measure one or more characteristics of the fluid. The sensor system of FIG. 2 also includes communication means, which include a plug 52 installed in the penetration 48 outward of the sensor 50. In some instances, the communication means can also include a controller (e.g., electronics 216 of FIG. 16) that allows local or remote monitoring. For example, locally, when a technician is present, a display of the controller can highlight parameters of interest, such as pressure, temperature, current, and voltage. This controller might further provide the ability to remotely monitor current annular conditions via a communication protocol.

As shown in FIG. 2, in some embodiments the sensor system is sealingly inserted in the penetration 48 with at least two metal seals—metal seal 54 and metal seal 56—located along the penetration 48. These two metal seals 54 and 56 allow environmentally safe measurements (e.g., pressure and temperature measurements) with dual barriers in place during measurement with the sensor 50. The pressure, temperature, or other characteristic may be read locally or remotely, and continuously or when desired. Either or both of the metal seals 54 and 56 are metal-to-metal seals in at least some instances, with sealing occurring between abutting metal surfaces of the body 40 and the sensor 50 for seal 54 and between abutting metal surfaces of the body 40 and the plug 52 for seal 56.

Figure 3:
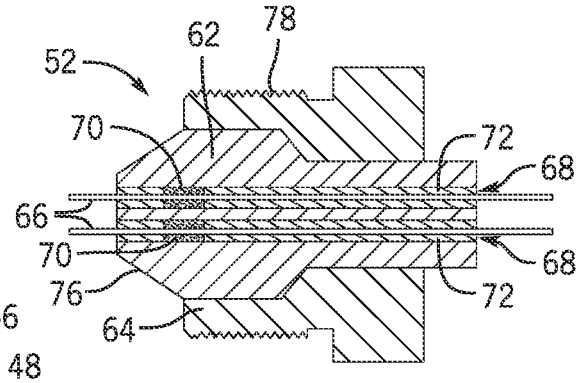
FIG. 3 depicts the plug of FIG. 2 in accordance with one embodiment.

The sensor 50 and the plug 52 can be installed in any suitable manner. In some instances, such as depicted in FIG. 2, the sensor 50 is threaded into the penetration 48 via a threaded interface 58, and the plug 52 is also threaded into the penetration 48 via a threaded interface 60. As shown in FIG. 3, the plug 52 can be an autoclave plug having a plug body 62 and a gland 64. Conductors 66 (e.g., metal pins) extend through the plug body 62 and allow communication between the sensor 50 and an external device (e.g., a controller or display unit) outside of the branch assembly. In at least some instances, a cable may be used to connect the external device to the conductors 66 of the plug 52. The sensor 50 can be coupled in electric communication with the conductors 66 in any suitable manner, such as via wires, a cable, or some other electric coupling. The conductors 66 are shown in FIG. 3 extending through bores 68 the plug body 62. Seals 70 in the bores 68 between the conductors 66 and the plug body 62 are pressure barriers and prevent flow through the bores 68. In at least some embodiments, the seals 70 are glass (e.g., glass beads) and provide glass-to-metal sealing against both the conductors 66 and the plug body 62. Additional insulation 72 (e.g., potting) may be provided in the bores 68.

As also depicted in FIG. 3, an end of the plug body 62 includes a sealing edge 76 and the gland 64 includes a threaded surface 78. The gland 64 can be threaded into the penetration 48 via threaded surface 78 and a mating threaded surface of the penetration 48 (these surfaces representing threaded interface 60) to push the sealing edge 76 against a mating sealing edge of the flange body 40 to provide a metal-to-metal seal 56.

Figure 4:
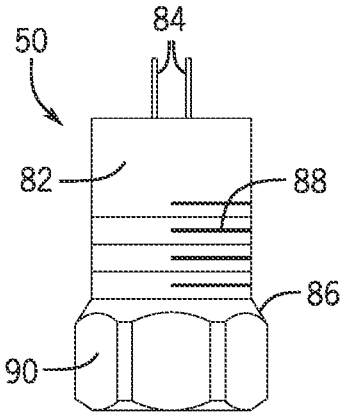
FIG. 4 depicts the sensor of FIG. 2 in accordance with one embodiment.

Additional details of the sensor 50 are depicted in FIG. 4. In this embodiment, the sensor 50 includes a body 82 (e.g., a metal body), communication pins 84 (or other conductors), a sealing edge 86, and a threaded surface 88. It will be appreciated that the body 82 can house internal sensing components and that the communication pins 84 may be used to pass signals between the internal sensing components and external devices. The pins 84 may be connected in electric communication with the conductors 66, as described above. The sensor body 82 may be threaded into the penetration 48 via threaded surface 88 and a mating threaded surface of the penetration 48 (these surfaces representing threaded interface 58). The sensor body 82 may be tightened against the flange body 40 such that the sealing edge 86 (e.g., a beveled surface) presses against a mating sealing edge of the flange body 40 to provide a metal-to-metal seal 54.

Figure 5:
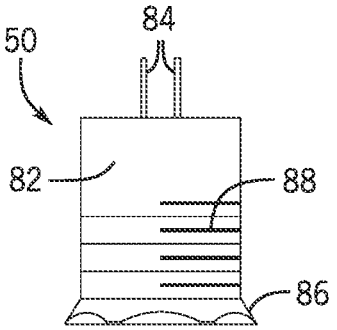
FIG. 5 depicts a sensor like that of FIG. 4 but with a lower profile that facilitates full-bore access through the instrument flange in accordance with one embodiment.

In some instances, such as shown in FIG. 4, the sensor 50 includes a head 90 (e.g., a hex head) to facilitate rotation and installation of the sensor 50 in the penetration 48. In other instances, such as in FIG. 5, the head 90 may be omitted. Omission of the head 90 may facilitate full-bore access to an access port of the wellhead 16 through the bore 42 and, more generally, through the bore of the branch assembly 30 in some embodiments. That is, such a sensor 50 may be installed in a manner in which the sensor 50 does not protrude into the bore 42 from the penetration 48. In some instances, a valve removal plug may be run through the branch assembly 30 and installed in an annulus access port to facilitate installation or removal of the sensor 50 or disconnection of components of the assembly 30.

The sensor 50 can be added (i.e., retrofitted) to an existing flange or included in a newly provided flange. And while flange 34 is depicted as an instrument flange in FIG. 2, it will be understood that the sensor 50 and plug 52 could be installed in some other equipment flange, such as in a flange of a valve or of another component. Still further, the sensor 50 and plug 52 could be installed in something other than a flange, such as in a (non-flange) portion of the body of a valve or of another component. The penetrations described herein can be formed in any suitable manner, which may include machining the penetrations in used components (for retrofitting these components with sensors 50) or in new components.

Figure 6:
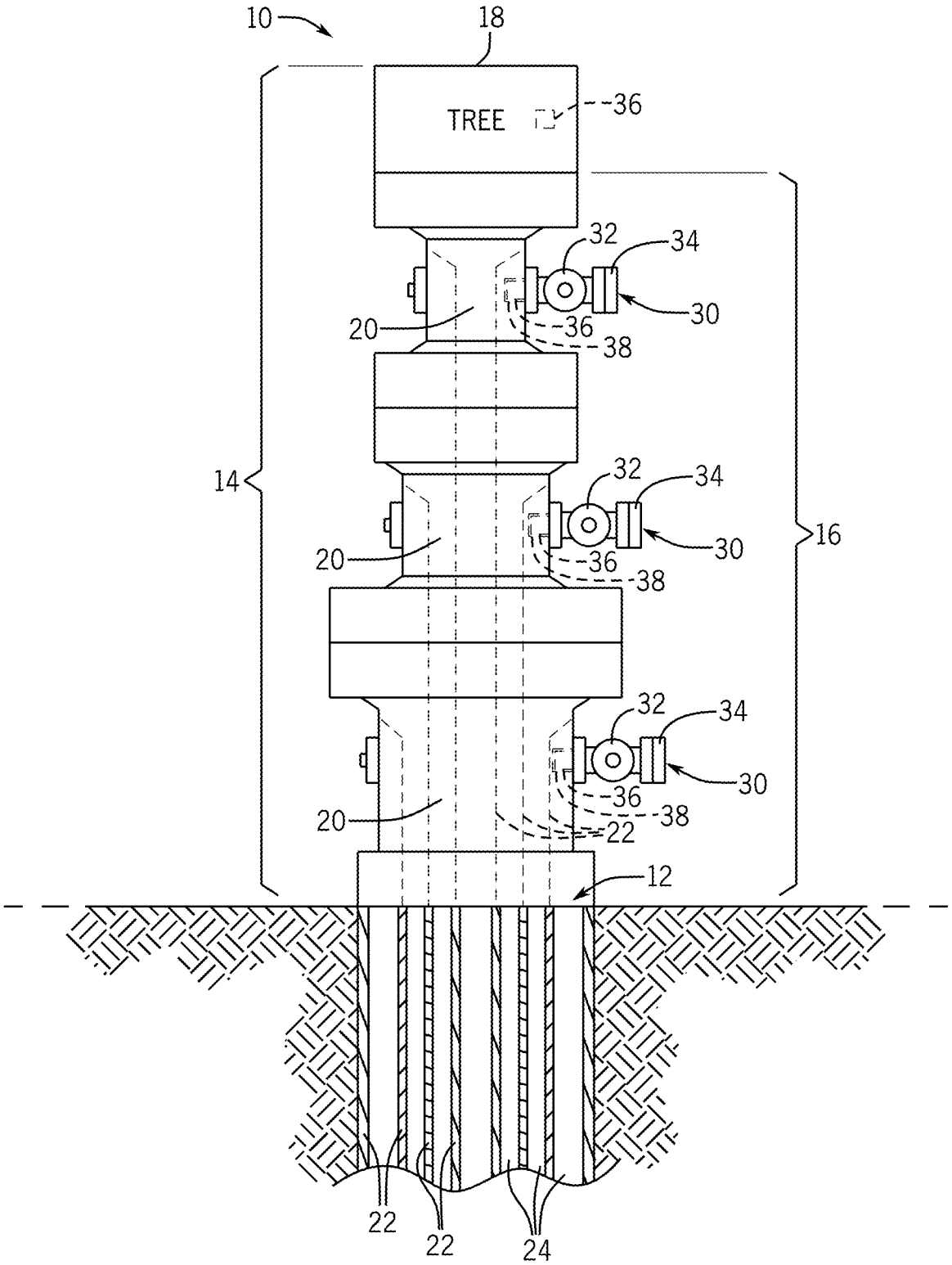
FIGS. 6-8 depict well apparatuses like that of FIG. 1 but with additional arrangements of the components of the branch assemblies in accordance with some embodiments.
Figure 7:
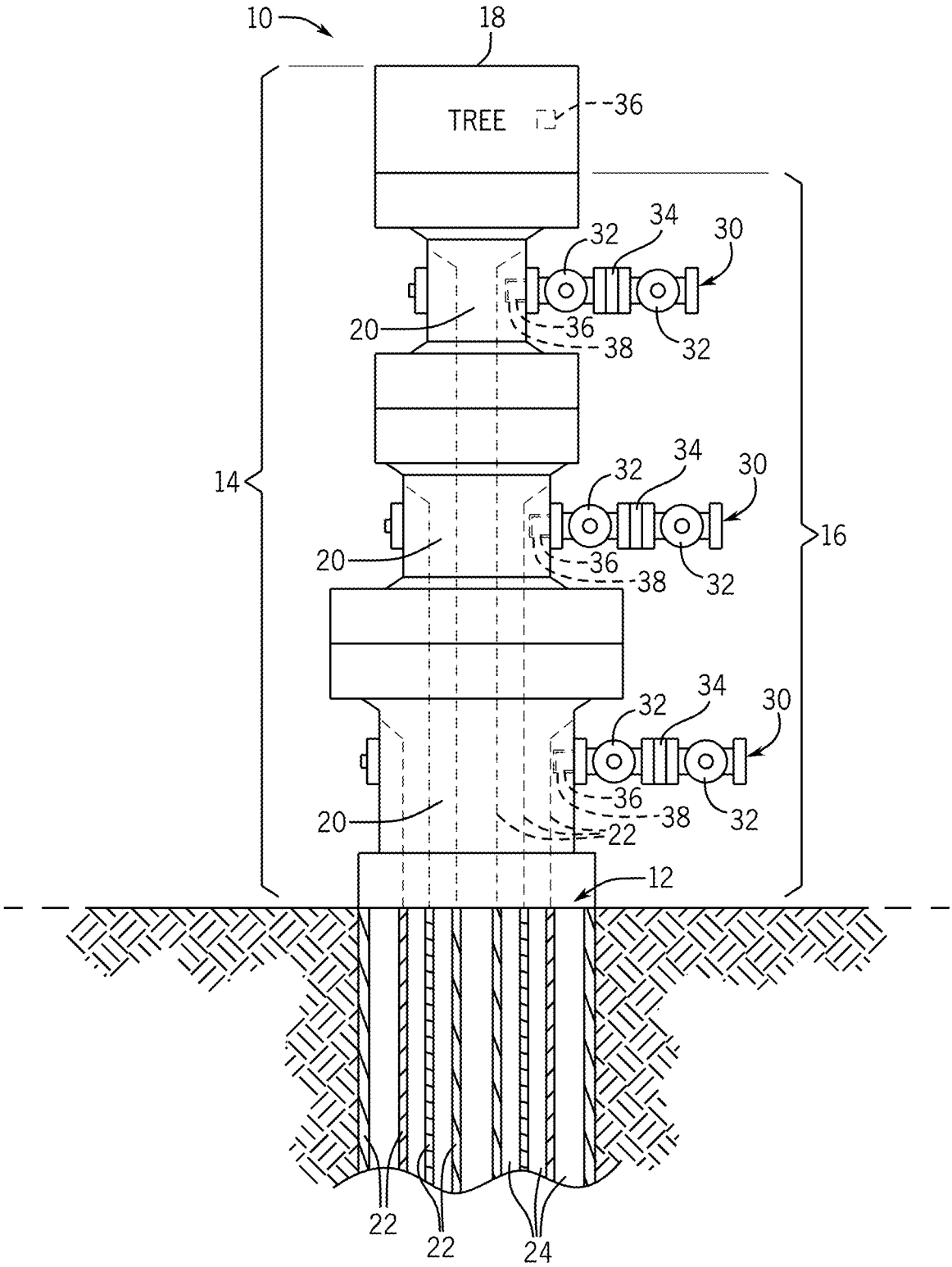
Figure 8:
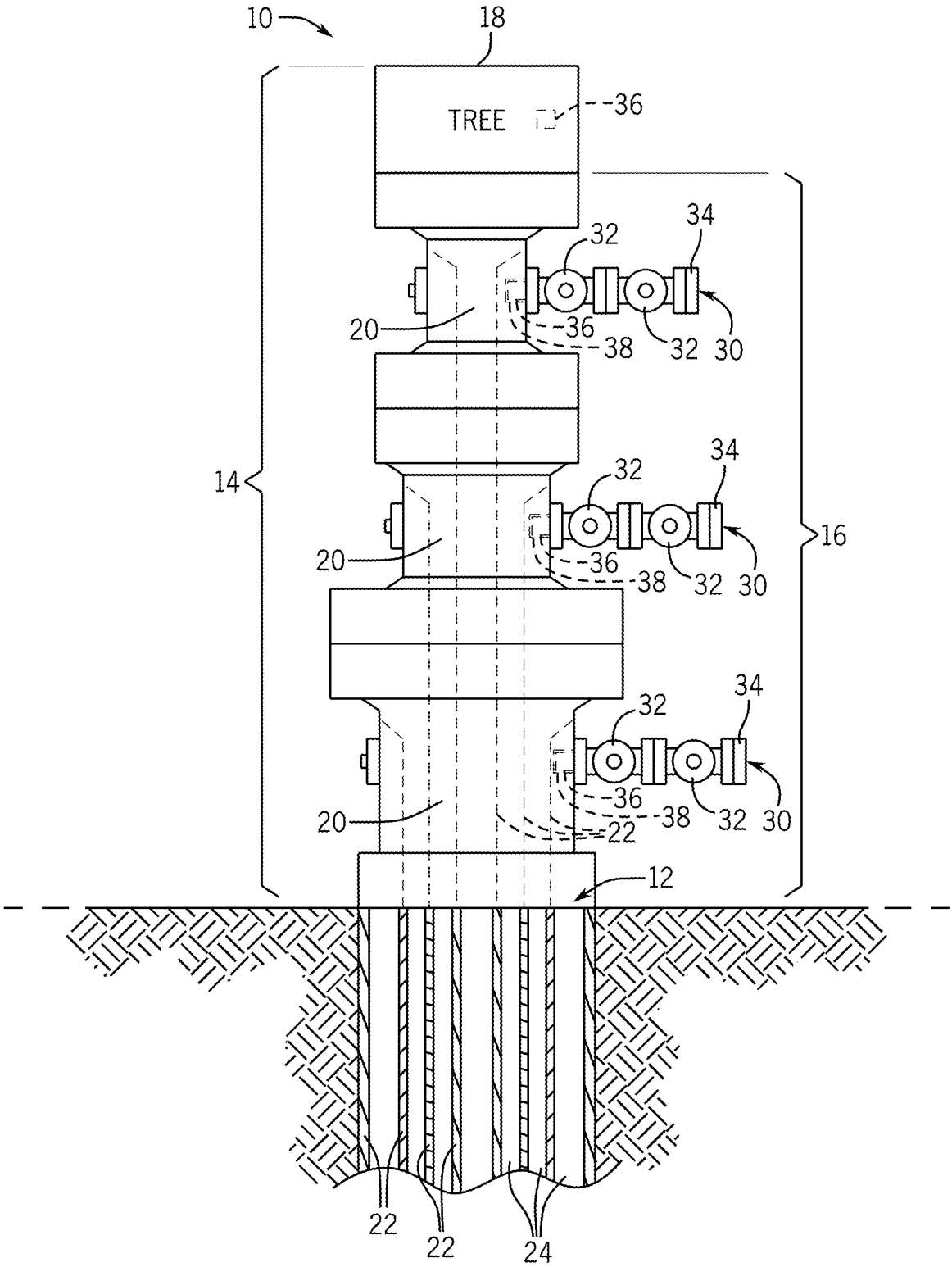
Figure 10:
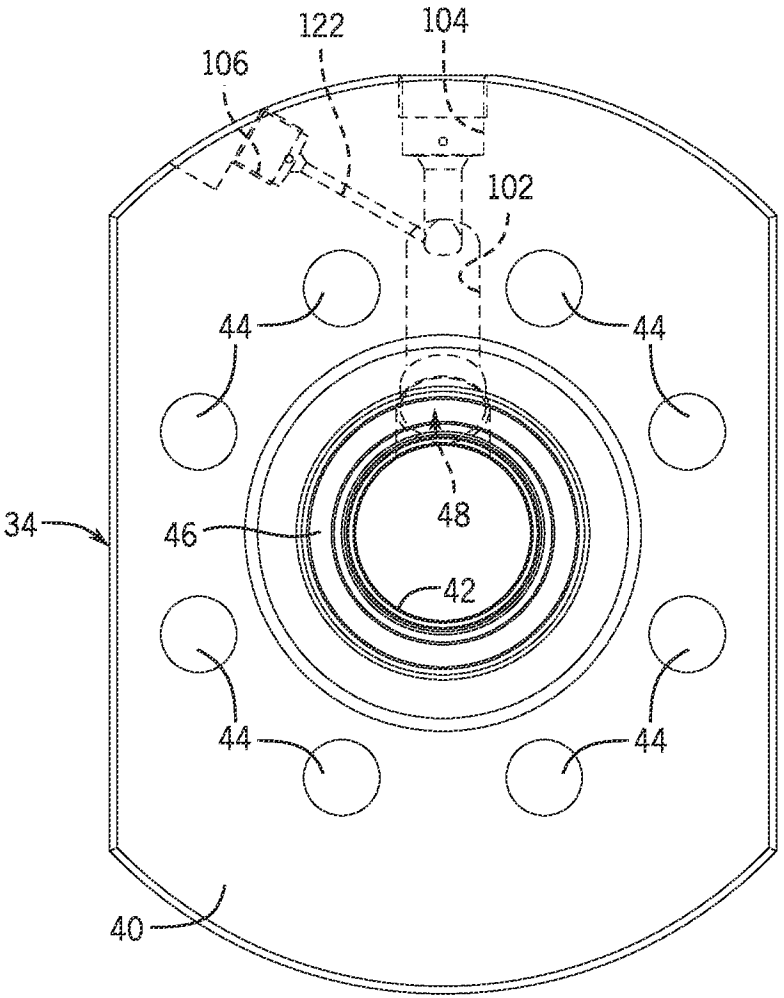
FIGS. 9-12 depict an instrument flange having a penetration with bores for receiving a sensor assembly and plug in accordance with one embodiment.

In some embodiments, an instrument flange 34 having the sensor 50 is installed in a branch assembly 30 between a wellhead body (e.g., a head 20) and one or more external valves 32, such as depicted in FIG. 1. In such instances, the external valves 32 (e.g., gate valves) are in fluid communication with the access passage of the head 20 through the instrument flange 34. But the instrument flange 34 having the sensor 50 could be located elsewhere in the branch assembly 30. In FIG. 6, for example, each branch assembly 30 includes an external valve 32 installed between the head 20 and the instrument flange 34, such that the instrument flange 34 is in fluid communication with the access passage of the head 20 through the connected valve 32. In FIG. 7, each branch assembly 30 is depicted as having an instrument flange 34 interposed between two external valves 32. And the instrument flange 34 is shown connected to a distal (outboard) end of a pair of external valves 32 in FIG. 8. It will be appreciated that additional valves, pipes, caps, or other components could be connected to the end of the depicted components of the branch assemblies 30 to route fluid or provide barriers to prevent leakage.

Figure 9:
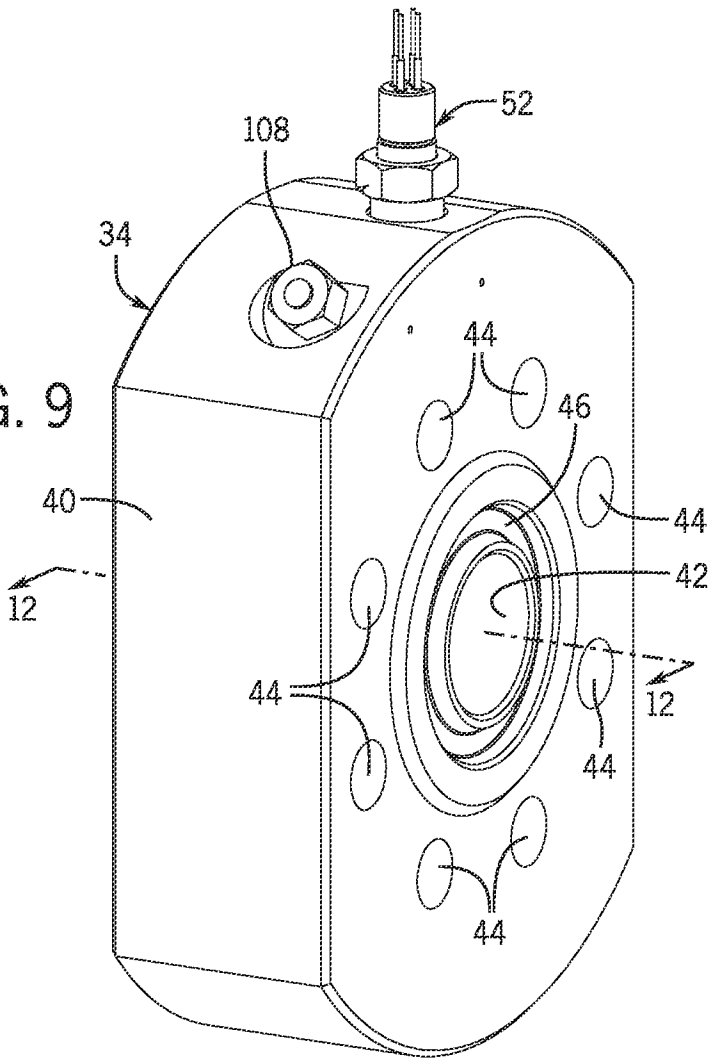
Figure 11:
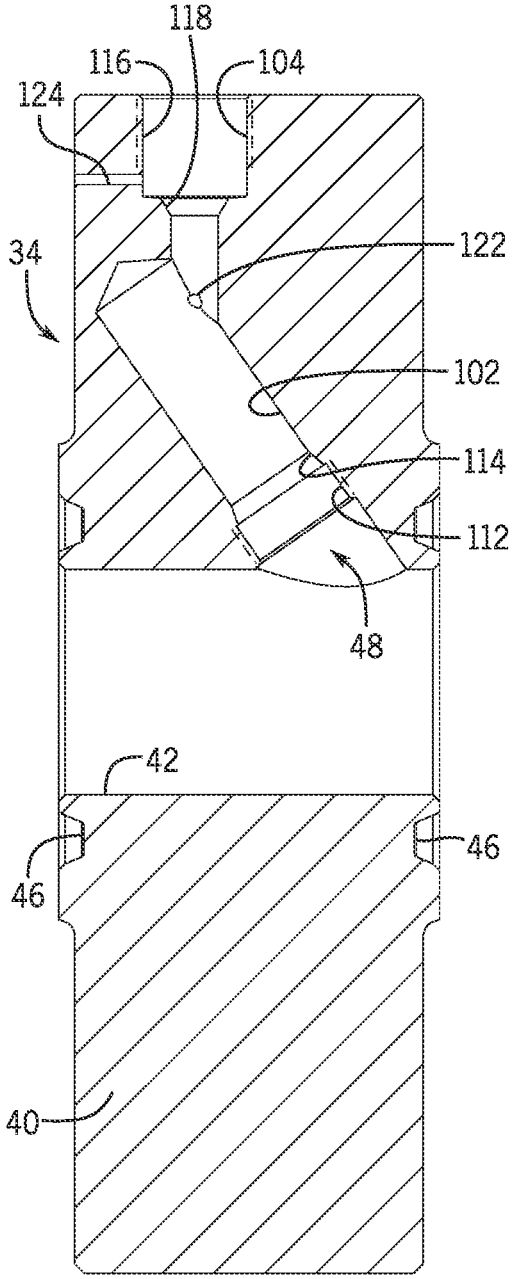

Another example of an instrument flange 34 for carrying a sensor 50 and measuring physical characteristics is depicted in FIGS. 9-12. In this depicted embodiment, the penetration 48 includes a bore 102 for receiving the sensor 50 and a bore 104 for receiving the plug 52. The body 40 of the flange 34 also includes a bore 106, which may receive a plug 108 as shown in FIG. 9. As shown in FIG. 11, the penetration 48 is formed at a non-perpendicular angle to the main bore 42. More specifically, the bore 102 is angled with respect to the main bore 42 to facilitate installation of the sensor 50 into the bore 102 from the main bore 42. This angle may also facilitate a more compact flange design.

Figure 12:
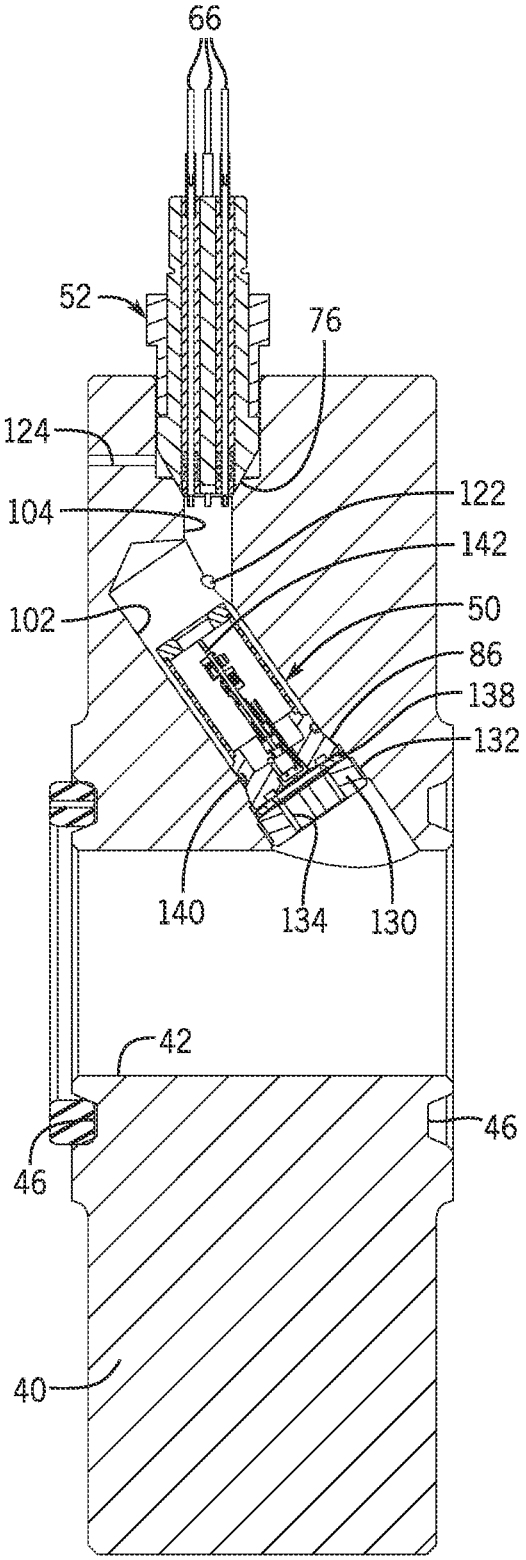

In this depicted embodiment, the bore 102 includes a threaded surface 112 and a sealing edge 114, and the bore 104 includes a threaded surface 116 and a sealing edge 118. As shown in FIG. 12, the sensor 50 can be installed in the bore 102 and the plug 52 can be installed in the bore 104. The body 40 also includes ports 122 and 124. The port 122 is a test port and extends from the bore 106 to a location at the penetration 48 between the sensor 50 and the plug 52, which allows pressure testing of seals (e.g., seals along sealing edges 76 and 86) or monitoring of pressure within a cavity between the sensor 50 and the plug 52. The primary barrier (the seal along sealing edge 86) is independent of the secondary barrier (the seal along the sealing edge 76) in at least some embodiments and sealing integrity can be verified through testing. The cavity pressure measurement between these two barriers (e.g., taken via the test port 122) can be used to indicate leakage past the primary barrier. In at least some instances, the sensor 50 can withstand pressure testing and operating pressures such that, if the primary barrier fails, the sensor 50 will still function and report one or more measured parameters (e.g., pressure or temperature). In one embodiment, a needle valve can be provided at the test port 122 to allow pressure monitoring for leakage, which monitoring can be continuous, as-wanted, or on an interim basis.

In at least some instances, the sensor 50 is installed in the flange 34 by passing the sensor 50 into the main bore 42 and then inserting the sensor 50 into the penetration 48 from the main bore 42. In the embodiment of FIG. 12, for example, the sensor 50 is inserted into the bore 102 from the main bore 42. A retaining nut 130 with threaded exterior surface 132 is threaded into the bore 102 (along threaded surface 112) to retain the sensor 50 within the penetration 48. An aperture 134 allows passage of fluid from the main bore 42 to the sensor 50 and may also be used as a tool slot to facilitate installation of the nut 130 in the bore 102 with a tool. A disc spring 138 may be installed between the sensor 50 and the retaining nut 130 to bias the sensor body 82 away from the bore 42 and seat the body 82 within the bore 102.

Figure 13:
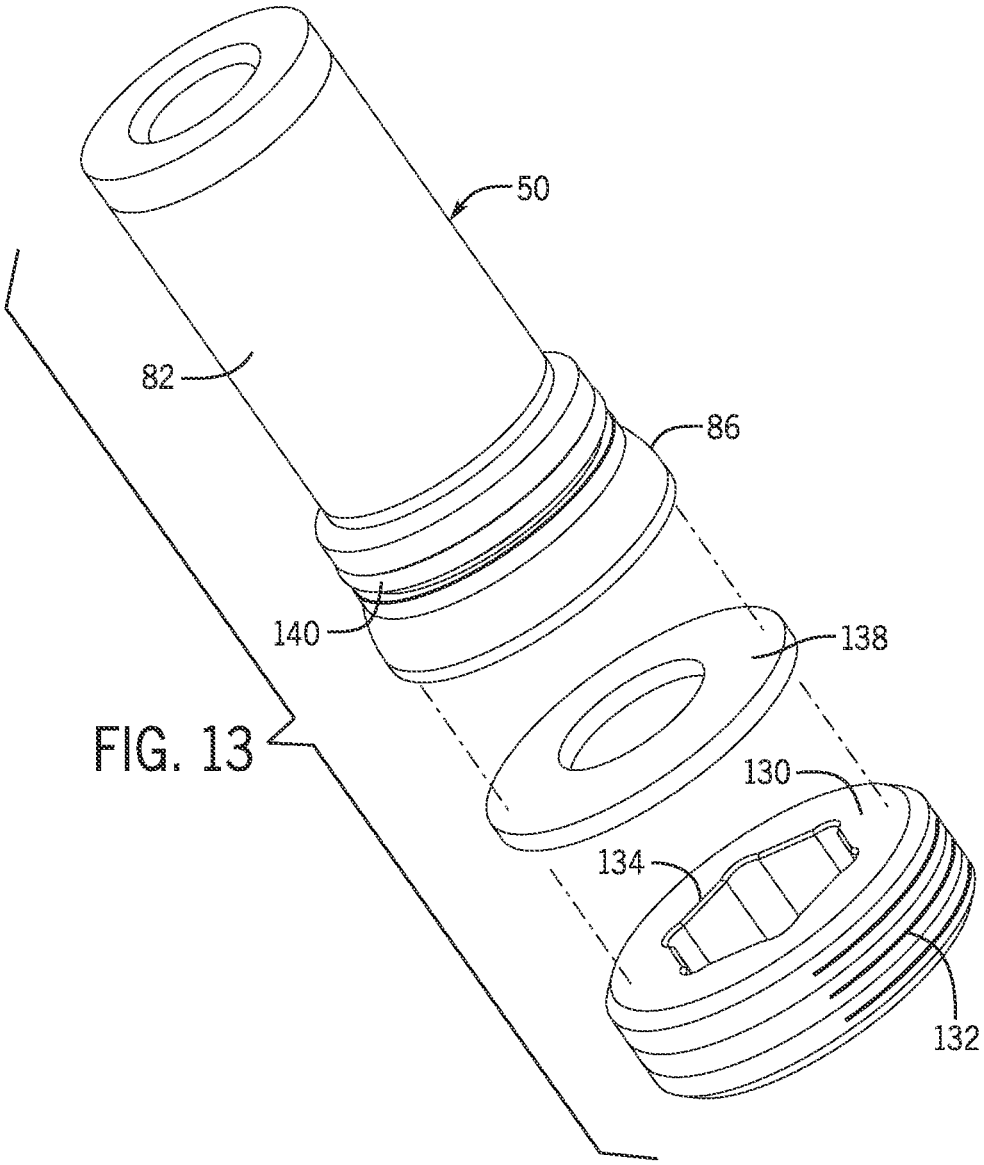
FIG. 13 is an exploded view of the sensor assembly of FIG. 12 in accordance with one embodiment.

With the sensor 50 installed in the bore 102, the sealing edge 86 abuts the sealing edge 114 to form a metal-to-metal seal. In this example, the metal-to-metal seal of edges 86 and 114 is a pressure-assisted seal. More specifically, when pressurized fluid is in the main bore 42, the pressure of the fluid applies a net force on the sensor 50 away from the main bore 42, which pushes the sealing edge 86 of the sensor 50 more tightly against the sealing edge 114 of the flange body 40. A further seal, such as an elastomer seal 140 (shown in FIG. 13 as an o-ring), may be provided in some instances.

As shown in FIG. 12, sensor electronics 142 may be housed within the sensor body 82. In some instances, the sensor electronics 142 include a printed circuit board with circuitry, such as a processor and memory on a printed circuit board, for processing a sensed signal indicative of a measured characteristic, such as temperature, pressure, density, or humidity. In other instances, the sensed signal may be passed from the sensor 50 to electronics located outside of the flange 34 (e.g., to allow high-temperature measurement while avoiding exposure of the electronics to excessive heat).

Figure 14:
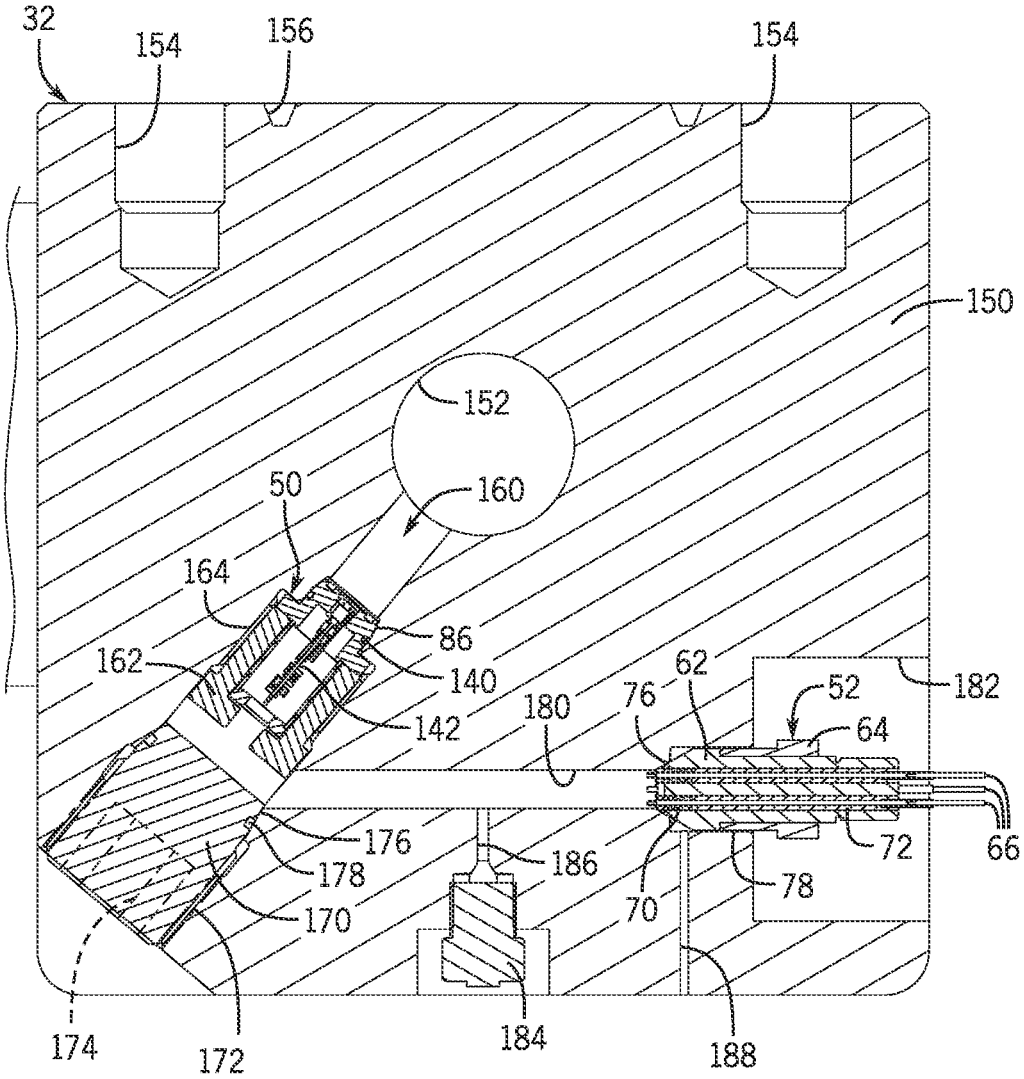
FIG. 14 depicts a valve body having a sensor and plug installed in a penetration in accordance with one embodiment.

While various examples of sensors 50 installed in flanges 34 are described above, sensors 50 may also or instead be installed in other equipment for measuring temperature, pressure, or other physical parameters. In some instances, a sensor 50 is installed in a wellhead body or a valve body for measuring one or more such parameters. As shown in FIG. 14 byway of example, a sensor 50 is installed in a body 150 of a valve 32 (which may be installed as part of a branch assembly 30). In this embodiment, the valve body 150 includes a main bore 152 extending through the body 150, mounting holes 154 (e.g., for mounting a valve bonnet), a seal groove 156, and a penetration 160 in which the sensor 50 is installed. A gland 162 is threaded into the penetration 160 via threaded interface 164 to secure the sensor 50 and cause sealing edge 86 to seal against a mating surface of the valve body 150 (e.g., to form a metal-to-metal seal). In at least some instances in which the valve 32 is coupled to a wellhead (e.g., as part of a branch assembly 30), the penetration 160 meets the main bore 152 at a location inboard of a closing element (e.g., a gate) of the valve 32, allowing the sensor 50 to measure parameters (e.g., annulus pressure and temperature) even when the valve 32 is fully closed. This location may also be inboard of another valve 32, so that two valves 32 outboard of the location may provide dual barriers to flow while allowing the sensor 50 to sense one or more parameters of interest. In contrast to embodiments depicted in FIGS. 2 and 12, the sensor 50 is inserted into the penetration 160 from an exterior of the body 150 rather than from the main bore within the body. But in other instances, a sensor 50 could be installed into the penetration 160 from the main bore 152, or a sensor 50 could be installed into a penetration of a flange 34 through an exterior surface of the flange 34.

A plug 170 is shown threaded into the penetration 160 via a threaded interface 172 and includes a tool slot 174 to facilitate installation. The plug 170 seals against the valve body 150 to create a second pressure barrier in the penetration 160. In at least some instances, the plug 170 includes a sealing edge 176 that abuts the valve body 150 for a metal-to-metal seal. An elastomer seal 178 (e.g., an o-ring) may also be provided on the plug 170. In one embodiment, the plug 170 is a valve removal plug sized to be installed in an access passage in a casing or tubing head 20 through which fluid from an annulus 24 is received in a branch assembly 30 (which may itself include the valve 32 having the sensor 50). The plug 170 may be removed from the valve body 150 to allow installation or removal of the sensor 50 in the penetration 160.

The sensor 50 may be electrically connected to the plug 52 (e.g., via wires or a cable) through a bore 180 in the valve body 150. The plug 52 seats against the valve body 150 to form a metal-to-metal seal. As shown in FIG. 14, the plug 52 may be positioned in a recess 182 of the valve body 150, which may protect the plug 52 from a dropped object. The valve body 150 can include additional ports, such as ports 186 and 188. The port 186 is a test port that allows pressure testing of seals (e.g., seals along sealing edges 76 and 86) or monitoring of pressure in the region between the sensor 50 and the plug 52, such as described above. A plug 184 may be used to close the test port 186, such as with a metal-to-metal seal between the plug 184 and the valve body 150.

Figure 15:
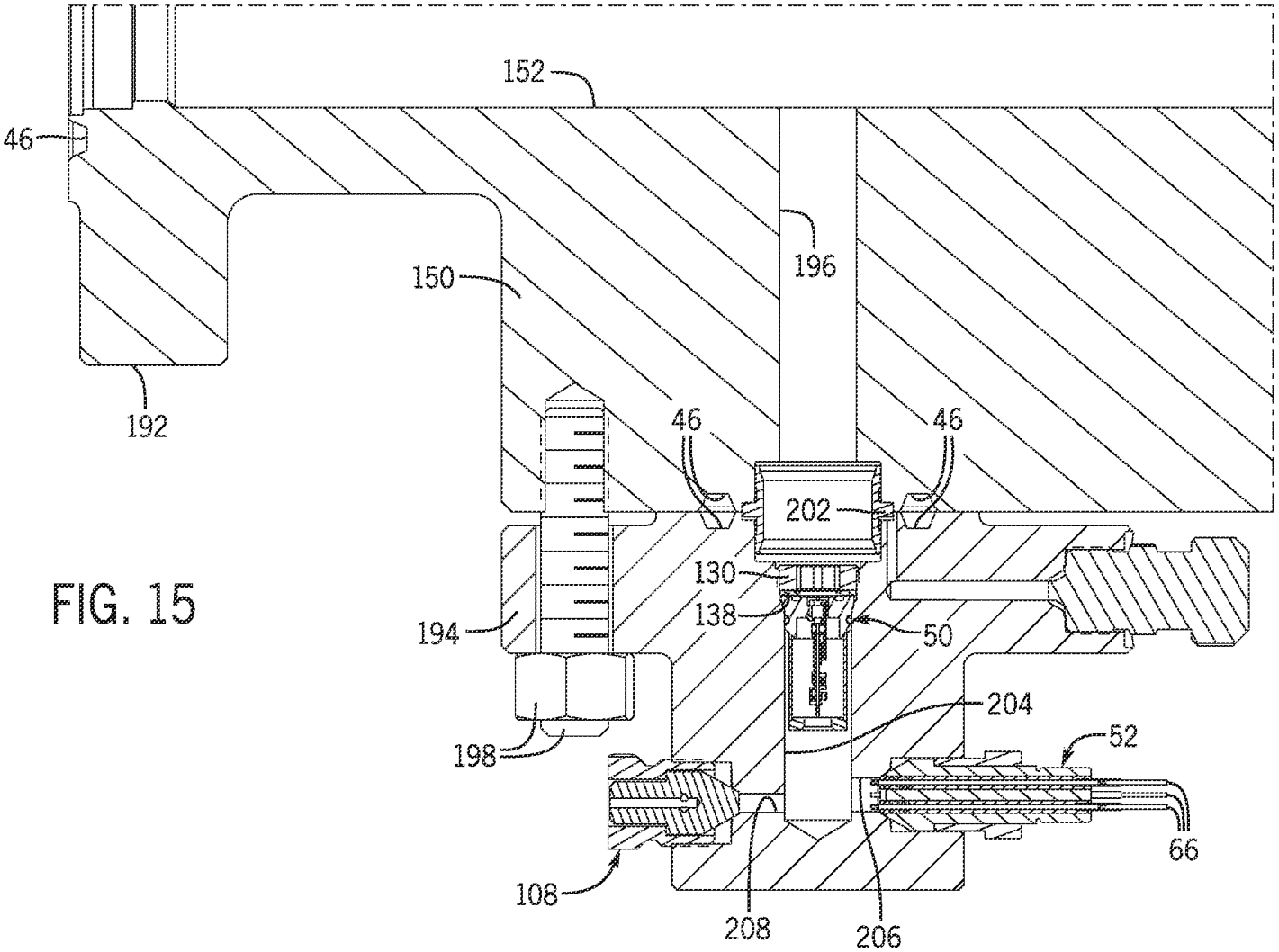
FIG. 15 depicts a valve and a blind flange having a sensor and plug installed in a penetration in accordance with one embodiment.

In another embodiment depicted in FIG. 15, the valve body 150 includes a flange 192 to facilitate connection of the valve to other equipment, such as a casing or tubing head 20, an instrument flange 34, or another valve 32. A blind flange 194 is coupled to the valve body 150 at a distal end of a bore 196 via fasteners 198. The interface between the blind flange 194 and the valve body 150 may be sealed via either or both of a seal ring 202 or a gasket that is installed in the seal grooves 46 along the interface. The valve body 150 may be installed as part of a branch assembly 30, and the blind flange 194 includes bores 204, 206, and 208 that, along with bore 196, are a penetration of the branch assembly. The sensor 50 may be installed in the bore 204 to measure physical parameters of a fluid (e.g., a fluid from an annulus 24) reaching the sensor 50 through the bores 152 and 196. In at least some instances, the bore 196 intersects the main bore 152 at a location inboard of a gate or other closing element of the valve 32 such that the sensor 50 can measure parameters, such as annulus pressure and temperature, even while the valve 32 is fully closed. The plug 52 may be installed in the bore 206 and can be used to facilitate communication between the sensor 50 and an external device, as described above. The sensor 50 and the plug 52 may each seat against the body of the flange 194 to provide a metal-to-metal seal, as also described above. And the bore 208 may be used as a test port to test these seals and monitor pressure within the cavity between the sensor 50 and the plug 52.

Figure 16:
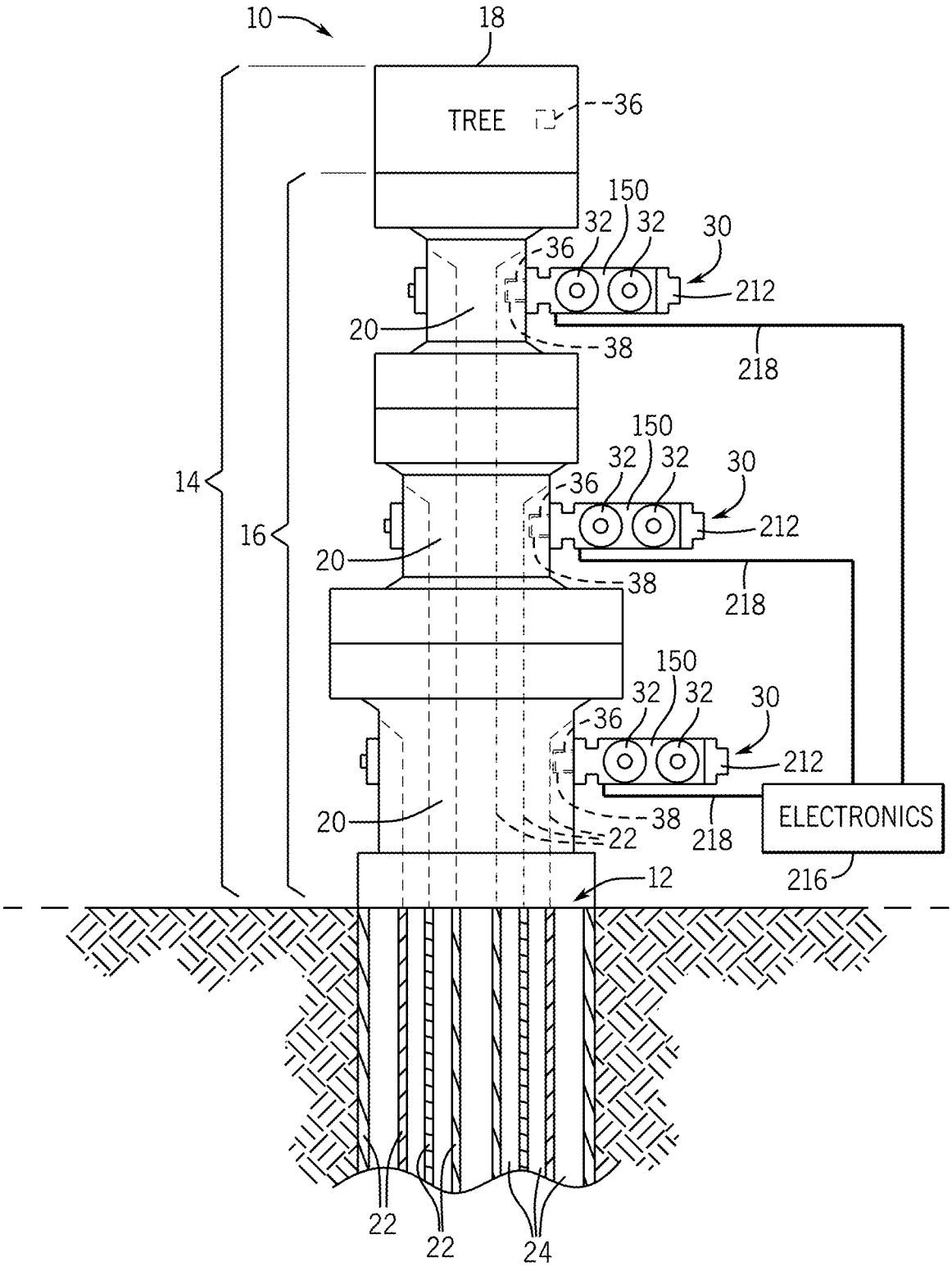
FIG. 16 depicts a well apparatus including electronics coupled to branch assemblies to communicate with sensors in the branch assemblies in accordance with one embodiment.

In FIG. 16, the apparatus 10 is generally shown with branch assemblies 30 each having two external valves 32 in a shared valve body 150. Although caps 212 are generally shown at the ends of the valve bodies 150, it will be understood that other equipment may also or instead be coupled to the valve bodies 150. The depicted apparatus 10 includes electronics 216 in communication with sensors 50 in the branch assemblies 30 (e.g., in the valve bodies 150 or in instrument flanges of the assemblies 30). As noted above, the electronics 216 can be located at a distance apart from the sensors 50, such as to reduce thermal damage to the electronics 216 in high-temperature measurement environments within the branch assemblies 30. The electronics 216 can communicate with the sensors 50 via cables 218 or in any other suitable manner. In at least some instances, the sensors 50 are installed at inboard ends of the shared valve bodies 150, allowing the sensors 50 to measure annulus pressure, temperature, or some other parameter even while the valves 32 are fully closed.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a wellhead body;

a branch assembly coupled to the wellhead body such that a bore of the branch assembly is in fluid communication with an interior of the wellhead body through an access passage of the wellhead body;

a sensor installed in a penetration of the branch assembly, the penetration extending outwardly from the bore to an exterior surface of the branch assembly that is radially outward of the bore; and a first metal-to-metal seal along the penetration and a second metal-to-metal seal along the penetration, wherein the first metal-to-metal seal along the penetration results from contact of a metal sealing surface of the sensor against an abutting surface of the branch assembly within the penetration.

2. The apparatus of claim 1, wherein the branch assembly includes a flange.

3. The apparatus of claim 2, wherein the flange has the penetration in which the sensor is installed.

4. The apparatus of claim 3, wherein the flange is an instrument flange.

5. The apparatus of claim 4, wherein the instrument flange is installed between the wellhead body and a gate valve such that the gate valve is in fluid communication with the access passage of the wellhead body through the instrument flange.

6. The apparatus of claim 4, wherein a gate valve is installed between the wellhead body and the instrument flange such that the instrument flange is in fluid communication with the access passage of the wellhead body through the gate valve.

7. The apparatus of claim 1, wherein the branch assembly includes a valve having the penetration.

8. The apparatus of claim 1, wherein the branch assembly provides full-bore access to the access passage.

9. The apparatus of claim 1, wherein the sensor is installed in an inner portion of the penetration of the branch assembly.

10. The apparatus of claim 9, comprising a plug installed in an outer portion of the penetration of the branch assembly.

11. The apparatus of claim 10, wherein the plug includes at least one conductor coupled in electric communication with the sensor such that an electric signal from the sensor can be passed through the plug via the at least one conductor.

12. The apparatus of claim 10, wherein the access passage of the wellhead body is an annulus access passage, and the plug includes a valve removal plug sized to be installed in the annulus access passage.

13. The apparatus of claim 1, wherein the penetration extends outward radially from the bore to the exterior surface of the branch assembly.

14. The apparatus of claim 1, wherein the penetration is not perpendicular to the bore of the branch assembly.

15. The apparatus of claim 1, wherein the first metal-to-metal seal is a pressure-assisted seal in which, upon receipt of a pressurized fluid within the bore, pressure of the fluid pushes the sensor against the abutting surface of the branch assembly.

16. The apparatus of claim 1, wherein the branch assembly includes two valves to provide dual barriers to flow through the branch assembly, and the penetration of the branch assembly meets the bore of the branch assembly at a location that is inboard of the two valves.

17. An apparatus comprising:

a branch assembly configured to be coupled to a wellhead body such that a bore of the branch assembly is in fluid communication with an interior of the wellhead body through an access passage of the wellhead body;

a sensor installed in a penetration of the branch assembly, the penetration extending outwardly from the bore to an exterior surface of the branch assembly that is radially outward of the bore; and a first metal-to-metal seal along the penetration and a second metal-to-metal seal along the penetration, wherein the first metal-to-metal seal along the penetration results from contact of a metal sealing surface of the sensor against an abutting surface of the branch assembly within the penetration.

18. An apparatus comprising:

a wellhead body;

a branch assembly coupled to the wellhead body such that a bore of the branch assembly is in fluid communication with an interior of the wellhead body through an access passage of the wellhead body;

a sensor installed in a penetration of the branch assembly, the penetration extending outwardly from the bore to an exterior surface of the branch assembly that is radially outward of the bore, wherein the sensor is installed in an inner portion of the penetration of the branch assembly; and a plug installed in an outer portion of the penetration of the branch assembly, wherein the access passage of the wellhead body is an annulus access passage, and the plug includes a valve removal plug sized to be installed in the annulus access passage.

* * * * *